US009091050B2

(12) United States Patent
Boyd

(10) Patent No.: US 9,091,050 B2
(45) Date of Patent: Jul. 28, 2015

(54) SYSTEM, METHOD AND APPARATUS FOR PATTERNED CEILING SUSPENSION

(75) Inventor: Alan Lane Boyd, Collegeville, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 13/339,053

(22) Filed: Dec. 28, 2011

(65) Prior Publication Data

US 2012/0167515 A1 Jul. 5, 2012

Related U.S. Application Data

(60) Provisional application No. 61/428,267, filed on Dec. 30, 2010.

(51) Int. Cl.
*E04B 9/00* (2006.01)
*E04B 9/06* (2006.01)

(52) U.S. Cl.
CPC ..... *E04B 9/068* (2013.01); *E04B 2009/062* (2013.01)

(58) Field of Classification Search
CPC ..... E04B 9/00; E04B 9/064; E04B 9/068; E04B 2009/062
USPC ..... 52/220.6, 506.06, 506.07, 836, 842, 52/846
See application file for complete search history.

(56) References Cited

U.S. PATENT DOCUMENTS 2,142,356 A 1/1939 Hastings
2,664,179 A * 12/1953 Gwynne ..... 403/387
3,123,185 A * 3/1964 Van Der Rijst ..... 52/633
3,319,389 A 5/1967 Levine
4,189,888 A 2/1980 Blitzer, Jr.
4,713,919 A * 12/1987 Platt ..... 52/232
4,742,662 A * 5/1988 Smith ..... 52/718.01
5,239,801 A * 8/1993 Adams ..... 52/506.07
5,265,393 A * 11/1993 Bischel et al. ..... 52/461
5,390,456 A * 2/1995 Platt et al. ..... 52/311.2
5,414,969 A * 5/1995 Krejci et al. ..... 52/311.3

(Continued)

FOREIGN PATENT DOCUMENTS

FR 2715179 A1 7/1995
GB 2142365 A 1/1985
WO 9317197 A1 9/1993

OTHER PUBLICATIONS

Applicant's admitted prior art; image of "CertainTeed Baroque Performance Series Mineral Fiber Ceilings" (1page).

(Continued)

*Primary Examiner* — Jeanette E Chapman
*Assistant Examiner* — James Buckle, Jr.
(74) *Attorney, Agent, or Firm* — Abel Law Group, LLP; Alexander H. Plache

(57) ABSTRACT

A ceiling suspension system has support members that are interconnected to support ceiling panels. The ceiling suspension system is suspended from a building. Each of the support members has a lower surface that is patterned and different in textural appearance than other portions of the support members to define patterned lower surfaces. For example, the patterned lower surfaces may have non-smooth textures that are uniform and symmetrical, or non-uniform and irregular. The patterned lower surfaces may have three-dimensional features such as lines, slots, dimples, protrusions, peaks and valleys and/or cross-hatching, which may be roll-formed on capping on the support members.

15 Claims, 6 Drawing Sheets

(56) References Cited

U.S. PATENT DOCUMENTS

| | | | | |
|---|---|---|---|---|
| 6,351,919 | B1 * | 3/2002 | Lin et al. | 52/506.07 |
| 6,722,098 | B2 * | 4/2004 | Platt | 52/506.05 |
| 7,240,460 | B2 * | 7/2007 | Platt | 52/506.07 |
| 7,520,095 | B2 * | 4/2009 | Platt et al. | 52/232 |
| 7,661,236 | B2 * | 2/2010 | Platt et al. | 52/506.06 |
| 7,669,374 | B2 * | 3/2010 | Miller et al. | 52/506.07 |
| 7,779,593 | B2 * | 8/2010 | Jahn et al. | 52/506.06 |
| 7,784,243 | B2 * | 8/2010 | Zahner, III | 52/846 |
| 8,146,316 | B2 * | 4/2012 | Boss et al. | 52/506.07 |
| 8,359,801 | B2 * | 1/2013 | Lehane et al. | 52/506.07 |
| 2003/0154686 | A1 * | 8/2003 | Platt | 52/733.1 |
| 2007/0277467 | A1 * | 12/2007 | Platt | 52/506.07 |
| 2008/0148668 | A1 * | 6/2008 | Jahn et al. | 52/506.07 |
| 2008/0155927 | A1 * | 7/2008 | Wendt et al. | 52/506.07 |
| 2008/0229680 | A1 * | 9/2008 | Jahn et al. | 52/105 |
| 2010/0077687 | A1 * | 4/2010 | Jankovec et al. | 52/506.07 |
| 2011/0023400 | A1 * | 2/2011 | Field et al. | 52/506.07 |
| 2011/0146184 | A1 * | 6/2011 | Lehane, Jr. | 52/506.07 |
| 2012/0167513 | A1 * | 7/2012 | Ahren | 52/506.07 |

OTHER PUBLICATIONS

Applicant's admitted prior art "Axiom®—Interlude® Product Description" © 2010 AWI Licensing Company (2 pages).

Applicant's admitted prior art; images of the hook vs. stab end detail for cross tees (2 pages).

Applicant's admitted prior art; image of Suspension grid system (1 pages).

Applicant's admitted prior art; image of exposed suspension grid system (1 page).

* cited by examiner

SYSTEM, METHOD AND APPARATUS FOR PATTERNED CEILING SUSPENSION

This application claims priority to and the benefit of U.S. Provisional Patent Application No. 61/428,267, filed Dec. 30, 2010, and is incorporated herein by reference in its entirety.

BACKGROUND

1. Field of the Disclosure

This disclosure generally relates to ceilings in buildings and, in particular to a system, method and apparatus for a pattern on the exposed face of a ceiling suspension grid that supports ceiling panels.

2. Description of the Related Art

Ceiling suspension systems for buildings typically comprise a series of roll-formed, metallic cross members that form a grid. The grid (which has a cross-sectional shape that is typically in the form of an inverted 'T') is supported on hangers from the buildings' structure. Ceiling tiles are supported by the grid to complete the ceiling surface. The thin, lowermost surfaces of the grid (typically called the face or cap) are usually exposed to view between the ceiling tiles. The faces of the grid are smooth, flat and featureless, and may be color matched or coordinated with the color of the ceiling tiles. For some applications, it may be desirable to diminish the visibility or contrast of the grid with the ceiling tiles. There have been numerous attempts to accomplish this and some have met with varying degrees of success. Improvements in ceiling suspension systems continue to be of interest.

SUMMARY

Embodiments of a system, method and apparatus for a ceiling system comprise support members that are interconnected to form a ceiling suspension. The ceiling suspension is suspended from a building structure. Each of the support members has exposed surfaces, such as facing or capping, that are patterned and different in textural appearance than other portions of the support members to define patterned surfaces.

For example, the patterned surfaces may have non-smooth textures that are uniform and symmetrical, or non-uniform and irregular. The patterned surfaces may have features such as lines, slots, dimples, protrusions, peaks and valleys and cross-hatching, which may be formed on capping on the support members. In other embodiments, other surfaces may be patterned like the patterned surfaces, such as for cloud perimeter trim.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
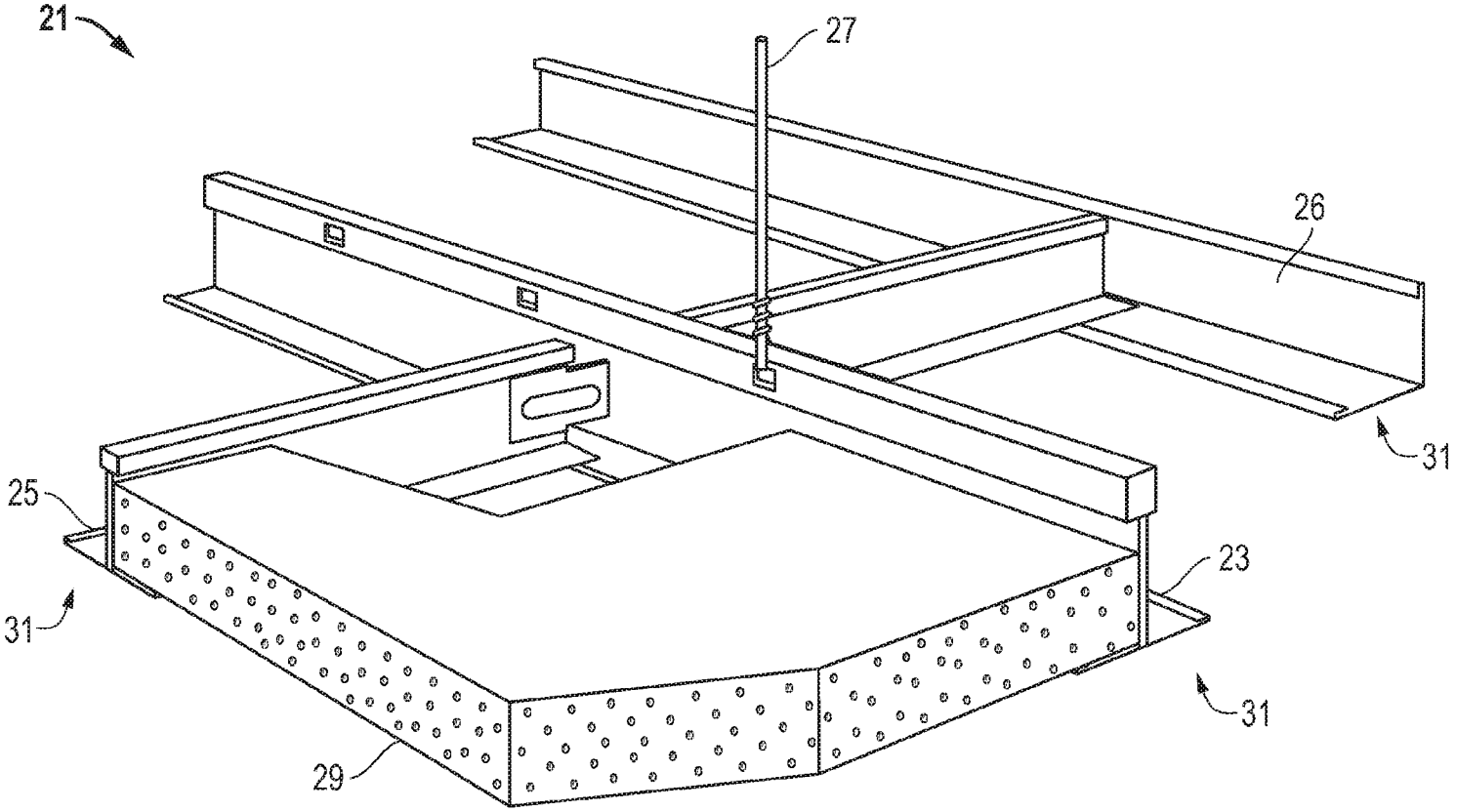
FIG. 1 is a schematic isometric view of an embodiment of a ceiling system.

FIGS. 1-9 disclose embodiments of a system, method and apparatus for a ceiling system. For example, as shown in the schematic drawing of FIG. 1, a ceiling system 21 may comprise a plurality of support members. The support members may be configured in many forms, such as main beams or runners 23, cross tees 25 and wall angle 26. The support members may be suitably roll-formed steel or aluminum, extruded aluminum, plastic, or fiber-reinforced plastic (FRP), depending on the application.

The metal raw materials (e.g., steel, aluminum, etc.) used in the roll-forming process arrives at the plant in coils. This material is about several inches wide, and about 0.012 to 0.020 inches thick, depending on the load rating desired from the finished grid product. For some applications, the steel is about 0.015 inches thick. The coils are unwound into a roll forming machine, which comprises a series of roll sets that progressively bend or fold the metal into the final shape desired. Each roll set represents a "step" in the process of roll-forming. Depending on the complexity of the finished shape, the number of roll sets can be as few as two or three (such as for forming a rain gutter), to as many as needed. For ceiling suspension t-bar type grids, the number of roll sets is generally about 16. A capping material, which also arrives at the plant in coils that are typically about 1 1/16 inches for a 1 5/16 inch-wide grid, is introduced at one of the later roll sets. This material can be steel or aluminum and is generally white, but could be any color. This material is crimped tightly onto the t-bar shape, which is formed continuously. A shear cuts the finished shape into pieces of the length desired. In the case of main runners, this is about 12 feet. Cross tees are commonly four feet and two feet in length, but can be custom made to any length. The slots, holes, and end joinery are all added later in the process in a press.

The support members for the ceiling system interconnect to form a ceiling suspension. The ceiling suspension may be suspended with wires or hangers 27 from a roof or floor support structure (not shown) in a building. The main runners 23, cross tees 25 and wall angle 26 may be substantially perpendicular, such that the ceiling suspension forms a grid for supporting ceiling tiles 29, as is known by those of ordinary skill in the art. A plurality of the ceiling tiles 29 is supported by the ceiling suspension to form a more aesthetically appealing ceiling beneath the usually less appealing exposed structure of a building.

There have been some attempts to change the appearance of grids to occupants in buildings. For example, some grids have been painted with irregular, non-symmetric features in an attempt to blend in with the ceiling tiles. Other attempts have included a fine grit in the paint used to color the grid to change the appearance of the grid to more of a matte finish. These designs were aesthetically unappealing and unsuccessful.

Figure 2:
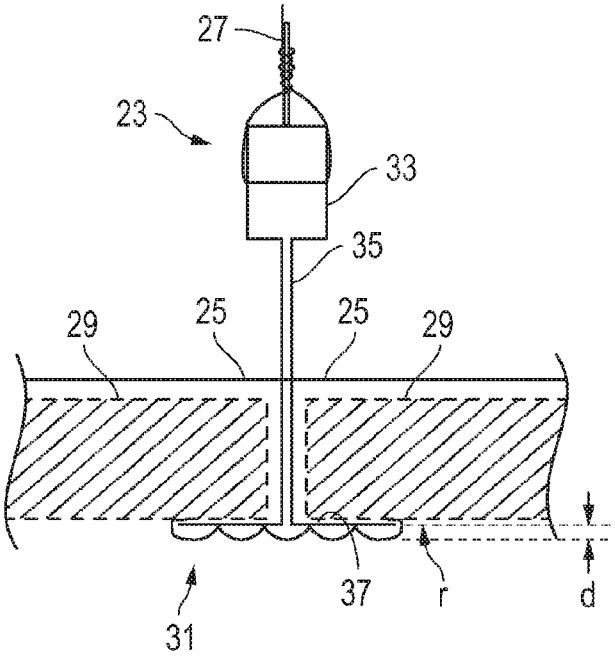
FIG. 2 is enlarged sectional end view of an embodiment of a beam or runner for the ceiling system.
Figure 3:
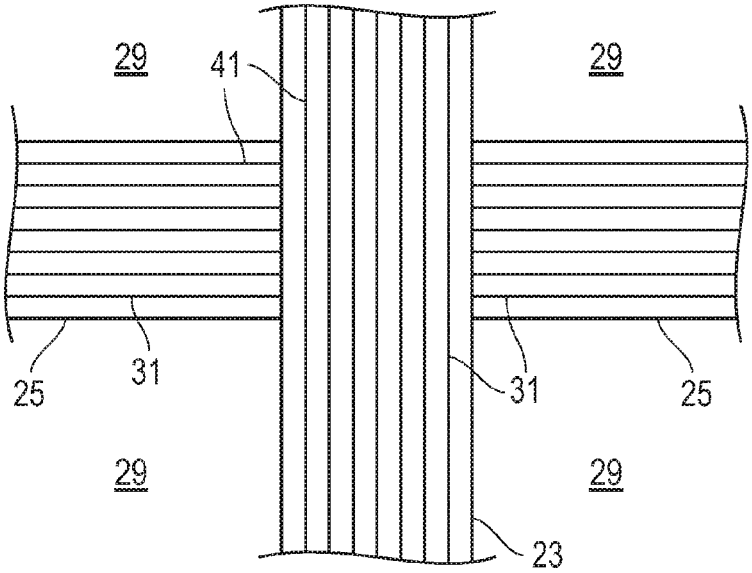
FIG. 3 is a bottom view of another embodiment of a runner and cross tees for a ceiling suspension system.
Figure 4:
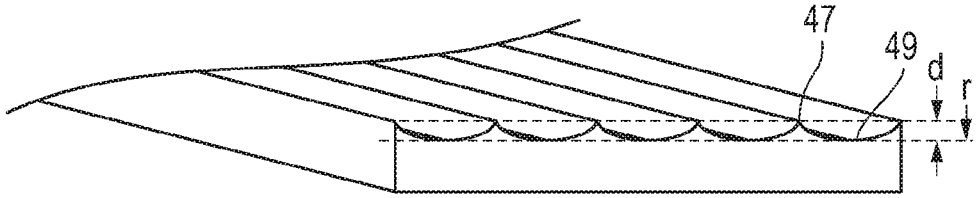
FIGS. 4 and 5 are isometric bottom views of alternate embodiments of surface designs for runners and cross tees.
Figure 5:
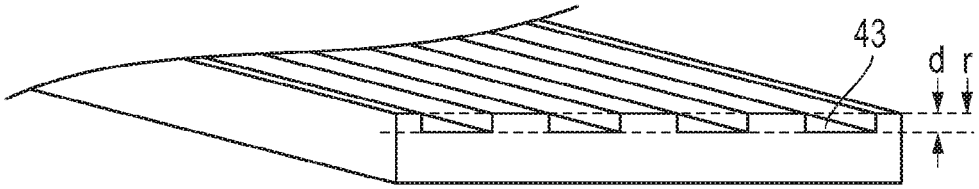
Figure 6:
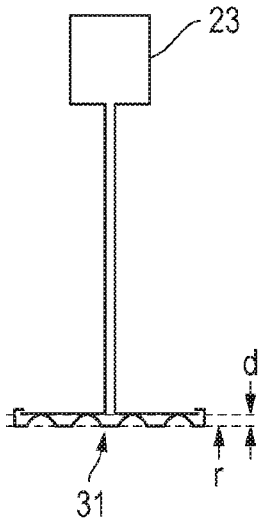
FIG. 6 is enlarged sectional end view of another embodiment of a runner for a ceiling suspension system.
Figure 7:
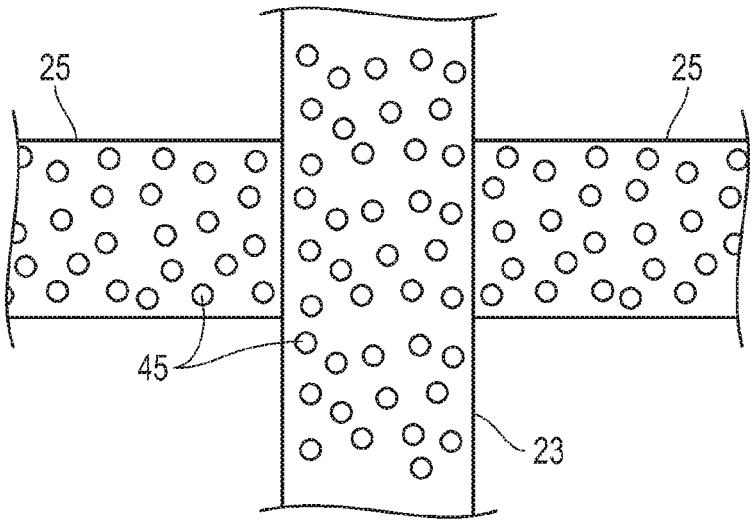
FIG. 7 is a bottom view of another embodiment of a runner and cross tees for a ceiling suspension system.

Referring now to FIGS. 1-3, each of the support members, such as main runners 23, cross tees 25 and wall angle 26, has a lower surface 31 that is patterned and different in textural appearance than other portions of the support members to define patterned lower surfaces 31. For example, the other portions of main runner 23 may comprise its bulb 33, web 35 and/or flange 37. The patterned lower surfaces 31 may comprise the lowermost surfaces of the support members. In some embodiments, the patterned lowermost surfaces 31 are located beneath a lowest portion of the ceiling tiles 29, as shown in FIG. 2.

The patterned lower surfaces 31 of the support members may comprise many different appearances and/or textures. For example, the patterned lower surfaces may be two-dimensional (e.g., printed) or three-dimensional, and may comprise non-smooth textures. The patterned lower surfaces may have features that are uniform and symmetrical (e.g., in two or three-dimensional configurations), non-uniform and irregular (e.g., in three-dimensional configurations), or a combination thereof.

The features used to form the different textural appearance may be roll-formed, stamped, embossed, machined or otherwise mechanically formed in the support members. A three-dimensional pattern may be impressed into the thin capping material, then secured on the lower ends of the t-bar shapes of the runners and cross tees, on wall angles, and on surfaces of cloud perimeter trim. In other embodiments, the features are painted, imaged or printed directly on these types of support members, or similarly placed on a flexible adhesive tape that is attached to the support members.

The metal raw materials (e.g., steel, aluminum, etc.) used in the roll-forming process arrives at the plant in coils. This material is about several inches wide, and about 0.012 to 0.020 inches thick, depending on the load rating desired from the finished grid product. For some applications, the steel is about 0.015 inches thick. The coils are unwound into a roll forming machine, which comprises a series of roll sets that progressively bend or fold the metal into the final shape desired. Each roll set represents a "step" in the process of roll-forming. Depending on the complexity of the finished shape, the number of roll sets can be as few as two or three (such as for forming a rain gutter), to as many as needed. For ceiling suspension t-bar type grids, the number of roll sets is generally about 16. The capping material, which also arrives at the plant in coils that are typically about 1 1/16 inches or 15/16 inches wide, is introduced at one of the later roll sets. This material can be steel or aluminum and is generally white, but could be any color. This material is crimped tightly onto the t-bar shape, which is formed continuously. A shear cuts the finished shape into pieces of the length desired. In the case of main runners, this is about 12 feet. Cross tees are commonly four feet and two feet in length, but can be custom made to any length. The slots, holes, and end joinery are all added later in the process in a press.

Other embodiments of the patterned lower surfaces may include lines 41 (see, e.g., FIG. 3) that may be parallel and symmetrically arrayed, slots 43 (see, e.g., FIG. 5), dimples 45 (see, e.g., FIG. 7), protrusions, peaks 47 and valleys 49 (see, e.g., FIG. 4), and/or cross-hatching.

As depicted in some of the drawings (e.g., FIGS. 4-6 and 8), the features of the three-dimensional embodiments may protrude or recede from a reference plane "r" by a distance "d." For example, if the features protrude outward (i.e., downward) from the support members, the reference plane r is defined as the mean plane from which the protrusions extend. If the features protrude inward (i.e., upward) from the support members, the reference plane r is defined as the mean plane from which the recessions recede. In some embodiments, the distance d may comprise about 0.015 to 0.250 inches, about 0.031 to 0.125 inches, or about 0.031 to 0.0625 inches.

Figure 8:
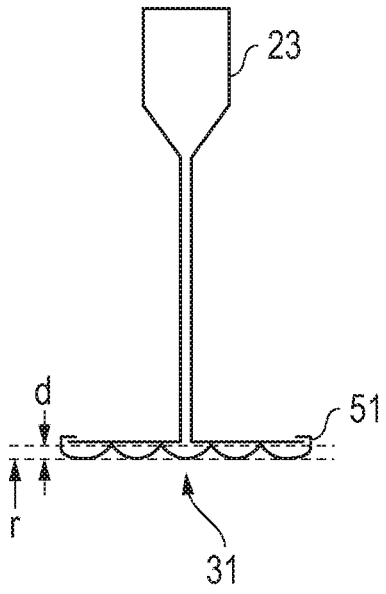
FIG. 8 is an enlarged sectional end view of an alternate embodiment of a runner for a ceiling suspension system.
Figure 9:
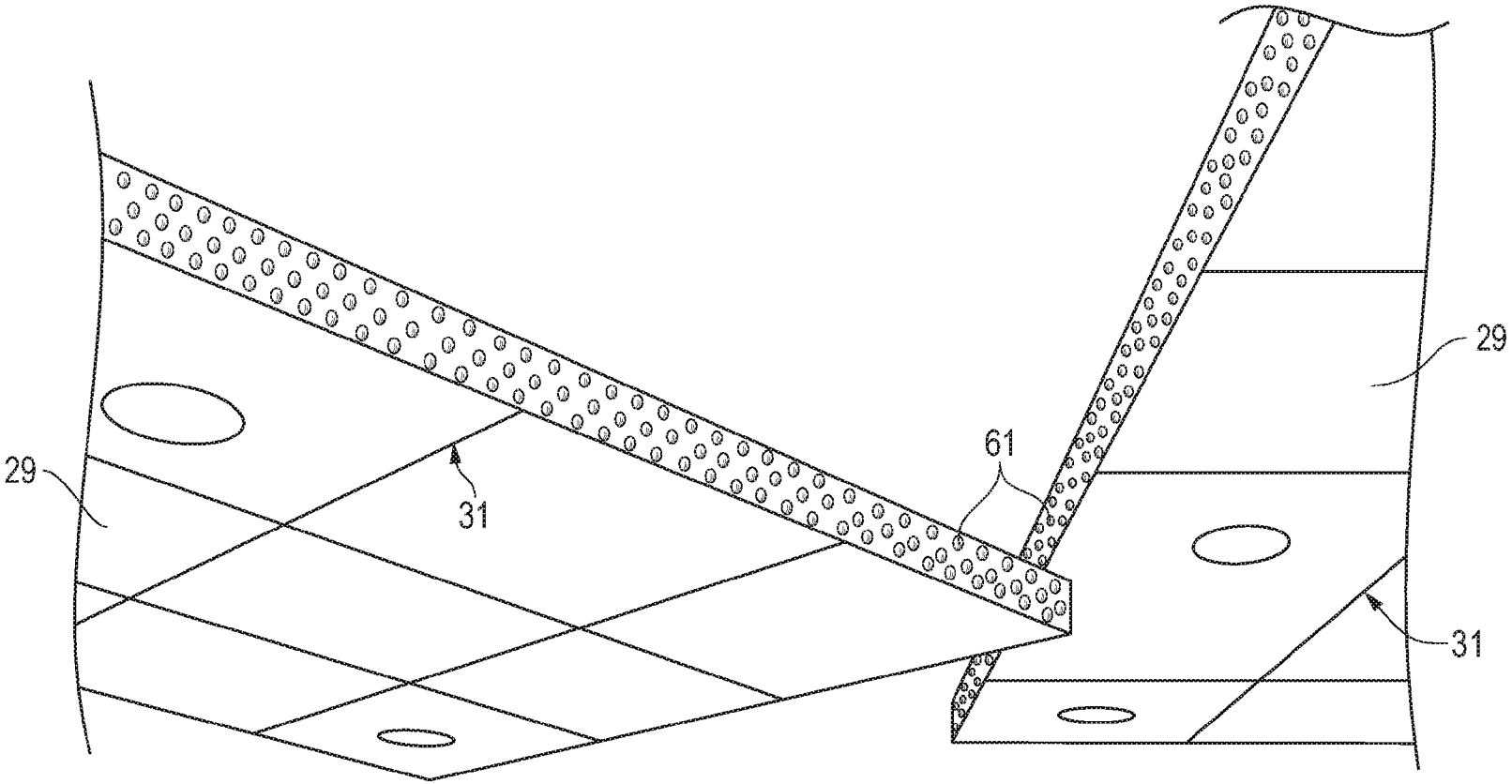
FIG. 9 is an isometric view of an embodiment of a cloud ceiling system having other than lower surfaces configured with the designs disclosed herein.

As shown in FIG. 8, the patterned lower surfaces 31 may be located and/or formed on capping 51 that is secured to lower ends of the support members, as is known to those of ordinary skill in the art. For example, the capping 51 may comprise a thickness of about 0.008 to 0.009 inches. The capping 51 may be patterned and different in textural appearance from the other portions of the support members, as described herein. The capping may comprise plastic or metallic materials.

In other embodiments (FIG. 9), at least some of the support members further comprise other non-horizontal surfaces 61 that are patterned like the patterned lower surfaces 31. In some versions, these other surfaces 61 may be referred to as "cloud perimeter trim." The other surfaces 61 may comprise out-of-plane, vertical, or substantially perpendicular structures to the patterned lower surfaces 31.

This written description uses examples to disclose the embodiments, including the best mode, and also to enable those of ordinary skill in the art to make and use the embodiments. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. The order in which activities are listed are not necessarily the order in which they are performed.

In the foregoing specification, the concepts have been described with reference to specific embodiments. However, one of ordinary skill in the art appreciates that various modifications and changes can be made without departing from the scope of the embodiments as set forth in the claims below. Accordingly, the specification and figures are to be regarded in an illustrative rather than a restrictive sense, and all such modifications are intended to be included within the scope of the embodiments.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of scope. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A ceiling system, comprising:

a plurality of support members that are interconnected to form a ceiling suspension and adapted to be suspended from a structure, the support members having a bulb, web and flange extending from the web, the flange having an upper surface and a lower surface, wherein the lower surface of the flange is patterned and different in textural appearance than other portions of the support members to define patterned lower surfaces on the lower surface of the flange;

at least some of the support members further comprise other surfaces that are other than the patterned lower surfaces, and the other surfaces also are patterned like the patterned lower surfaces; and a plurality of ceiling tiles supported by upper surfaces of the flanges to form a ceiling in the structure, and the patterned lower surfaces are located beneath a lowest portion of the ceiling tiles.

2. A ceiling system according to claim 1, wherein the patterned lower surfaces are lowermost surfaces of the support members, and the flange and patterned lower surfaces of the flange comprise a single component.

3. A ceiling system according to claim 1, wherein the patterned lower surfaces are defined from a reference plane "r" of the flange and extend therefrom by a distance "d" comprising 0.015 to 0.250 inches.

4. A ceiling system according to claim 3, wherein the distance "d" comprises 0.031 to 0.125 inches.

5. A ceiling system according to claim 1, wherein the patterned lower surfaces have features selected from the group consisting of lines, slots, dimples, protrusions, peaks and valleys and cross-hatching.

6. A ceiling system according to claim 1, wherein the patterned lower surfaces of the support members are two-dimensional or three-dimensional.

7. A ceiling system according to claim 1, wherein the patterned lower surfaces are painted or printed.

8. A ceiling system according to claim 1, wherein the other surfaces are out-of-plane, vertical, or substantially perpendicular to the patterned lower surfaces.

9. A ceiling suspension system, comprising:

a plurality of support members having main runners and cross tees that are substantially perpendicular and interconnected to form a ceiling suspension grid, and adapted to be suspended from a structure;

capping crimped tightly to upper and lower ends of the support members, the crimped capping having a lower surface that is patterned and different in textural appearance than the support members to define patterned lower surfaces on the lower surface of the crimped capping itself that form a lowermost portion of the ceiling suspension system, such that no other portion of the ceiling suspension system is coupled to the patterned lower surfaces;

at least some of the support members further comprise other surfaces that are other than the patterned lower surfaces, and the other surfaces also are patterned like the patterned lower surfaces; and the support members have flanges with upper surfaces configured to support ceiling tiles.

10. A ceiling suspension system according to claim 9, wherein the patterned lower surfaces are three-dimensional and defined from a reference plane "r" of the support members and extend therefrom by a distance "d" comprising 0.015 to 0.250 inches.

11. A ceiling suspension system according to claim 9, wherein the patterned lower surfaces have features that are uniform and symmetrical, or non-uniform and irregular, and the capping is a lowermost portion of the ceiling suspension system and configured to be located below ceiling tiles supported by the ceiling suspension system.

12. A ceiling suspension system according to claim 9, wherein the patterned lower surfaces have features selected from the group consisting of lines, slots, dimples, protrusions, peaks and valleys and cross-hatching.

13. A ceiling suspension system according to claim 9, wherein the support members are roll-formed steel or aluminum, or extruded aluminum.

14. A ceiling suspension system according to claim 9, wherein the other surfaces are out-of-plane, vertical, or substantially perpendicular to the patterned lower surfaces.

15. A ceiling suspension system, comprising:

a plurality of support members having main runners and cross tees that are substantially perpendicular and interconnected to form a ceiling suspension grid, and adapted to be suspended from a structure;

capping crimped to lower ends of the support members, the capping having a lower surface that is patterned and different in textural appearance than the support members to define patterned lower surfaces that form a lowermost portion of the ceiling suspension system, such that no other portion of the ceiling suspension system is coupled to the patterned lower surfaces;

the support members have flanges with upper surfaces configured to support ceiling tiles; and at least some of the support members comprise vertical surfaces that are other than the patterned lower surfaces, the vertical surfaces also are patterned like the patterned lower surfaces, and the vertical surfaces are out-of-plane or substantially perpendicular to the patterned lower surfaces.

* * * * *